United States Patent [19]

Ehlers

[11] Patent Number: 4,735,243

[45] Date of Patent: Apr. 5, 1988

[54] SAFETY DEVICE FOR A LIQUID-DISPENSING NOZZLE FOR FUEL

[76] Inventor: Karlheinz Ehlers, Dörpfeldstr. 35b, D-8000 Hamburg 52, Fed. Rep. of Germany

[21] Appl. No.: 894,365

[22] Filed: Aug. 7, 1986

[30] Foreign Application Priority Data

Aug. 9, 1985 [DE] Fed. Rep. of Germany ..... 3528612

[51] Int. Cl.[4] ..... B65B 3/28; B65B 57/14

[52] U.S. Cl. ..... 141/218; 141/392; 141/206; 141/209

[58] Field of Search ..... 141/392, 206–229

[56] References Cited

U.S. PATENT DOCUMENTS

| | | | |
|---|---|---|---|
| 3,224,472 | 12/1965 | Ehlers | 141/209 |
| 3,233,641 | 2/1966 | Ehlers | 141/209 |
| 3,323,560 | 6/1967 | Ehlers | 141/208 |
| 4,331,187 | 5/1982 | Trygg | 141/218 |
| 4,343,336 | 8/1982 | Trygg | 141/218 |
| 4,450,879 | 5/1984 | Wood | 141/209 |

*Primary Examiner*—Henry J. Recla
*Assistant Examiner*—Ernest G. Cusick
*Attorney, Agent, or Firm*—Karl F. Ross; Herbert Dubno

[57] ABSTRACT

The liquid-dispensing pistol-grip nozzle comprises a filling hose liquid-dispensing device equipped with a delivery pump which can be turned on and shut off, a valve housing with a spigot, a filling hose connector and a connected fuel duct, an operating mechanism with a pistol-grip handle and if necessary a flow rate setting mechanism for the pistol-grip handle, an automatic shut off device and a safety device. The automatic shut off device which operates a locking mechanism has a pressure equalizing chamber, a chamber-separating control membrane and a vacuum chamber with a filling state sensing duct with a vacuum duct opening near the delivery valve seat in the valve housing. The control membrane is connected with flexible free play to a hollow piston shaft of a safety piston guided in the valve housing which is movable between a locked in position and a locked out position. The safety piston is a differential piston with a small effective piston surface and a large effective piston surface. In the locked out position its small effective surface can be acted on by the pressure in the filling hose connector. After overcoming the compressive force of the safety piston spring in its locked in position the large effective surface can be acted on by the pressure in the filling hose connector.

4 Claims, 3 Drawing Sheets

SAFETY DEVICE FOR A LIQUID-DISPENSING NOZZLE FOR FUEL

FIELD OF THE INVENTION

My present invention relates to a nozzle for dispensing liquid and, more particularly, to a nozzle for dispensing liquid fuel with a pistol-grip handle and an automatic termination of fuel feed when the tank is filled (see my U.S. Pat. Nos. 3,233,641 and 3,224,472).

BACKGROUND OF THE INVENTION

A liquid-dispensing pistol-grip nozzle for fuel is connected by a filling hose to the liquid-dispensing machine or metering unit equipped with a delivery pump which can be turned on and shut off. The nozzle can comprise a valve housing with a spigot, a filling hose connector for connecting the nozzle with the filling hose, a fuel duct in the nozzle, an operating mechanism with a pistol-grip handle and if necessary a flow rate setting mechanism usually in the pistol-grip handle, an automatic shut off device and a safety device.

A valve seat can be located near the upstream end of the valve housing. An associated valve body loaded by a closing spring can be mounted in the valve housing and fitted with an axially slidable valve stem which cooperates with the seat. The valve stem is a hollow spindle in which is guided a slidable pull rod connected with the pistol-grip handle. The valve spindle and the pull rod are couplable and uncouplable by a locking mechanism belonging to the automatic shut off device.

The automatic shut off device can have a pressure equalizing chamber, a vacuum chamber with a filling state sensing duct and with a vacuum duct opening near the valve seat and a chamber-separating control membrane which operates the locking mechanism, the control membrane having a control membrane spring with which the shut off low pressure of the automatic shut off is set.

Further, the control membrane can be connected with flexible free play to a hollow piston shaft of a safety piston guided in the valve housing which is movable between a locked in position and a locked out position. On the side facing away from the control membrane the safety piston is acted upon by pressure in the filling hose connector communicated thereto by a pressure duct and is supported with a safety piston spring in the valve housing on the control membrane. The locked in position and/or the locked out position indicate configurations in which the locking mechanism is lockable into and/or lockable out of. In one position the valve cannot be operated because of failure of the fuel supply while in the other the fuel can be dispensed.

In the known liquid-dispensing nozzle (U.S. Pat. No. 4,331,187) the safety mechanism uses a ring which seals at the vacuum chamber. This mechanism impairs the reliability of operation when the soft flexible material used in the sealing ring changes its shape for example by swelling. Variations in the motion-direction-dependent friction are also troublesome.

In this aforementioned mechanism the safety device causes a reliable locking out when the delivery pump with open delivery valve is shut off or when an attempt is made to open the delivery valve after such a shut off. A shut off should be possible when a pressure exists in the filling hose and consequently also in the filling hose connector whose upper limit is determined by the loading of the delivery valve on the one hand and the pressure maintained in the switched off delivery pump on the other hand.

Consequently, additional steps were required in this known liquid-dispensing nozzle in order to attain the desired operation, namely a pressure relief for the filling pump hose and also the safety piston after shutting off the delivery pump. Suitable flow ducts were provided which lead to the spigot. The pressure relief thus causes a delivery of a residual quantity by the spigot which is frequently disturbing. Besides, the safety piston and the safety piston spring could not be conveniently designed for the full delivery pump pressure of the operating delivery pump, although it acts with the delivery pump turned on and the delivery valve closed with the pistol-grip handle in the closed position and the locking mechanism locked out.

Actually this pressure falls off a fraction for hydrodynamic reasons in the filling hose and in the filling hose connector when the fuel is delivered in a complete flow by the spigot in due course. In this operating condition a reliable locking out by the safety piston may not occur, since the safety piston spring must be weakened. That allows a haphazard emptying of the filling hose after shut off of the delivery pump which can occur inadvertently, e.g. by compressing it. That also allows a failure of the delivery system when the delivery pump because of a disorder is not brought to its full delivery pressure or for some reason the complete liquid flow does not reach the filling tube connector and consequently the automatic hydrodynamically controlled shut off device does not function for hydrodynamic reasons. In this case the liquid-dispensing nozzle may pose a danger since, for example, a vehicle tank to be filled can uncontrollably be caused to overflow.

OBJECTS OF THE INVENTION

It is an object of my invention to provide a liquid-dispensing nozzle which represents an improvement over my earlier devices as described in the aforementioned patents and which eliminates drawbacks of the prior art.

It is also an object of my invention to provide an improved liquid-dispensing nozzle in which the above described pressure relief is not required and the liquid-dispensing nozzle can be operated satisfactorily even when there is a disorder or interruption of the delivery pump, which leads to a reduction in the delivery pump pressure in contrast to the rated delivery pump pressure or when there is a filter blockage.

SUMMARY OF THE INVENTION

These objects and others which will be made more apparent hereinafter are attained in a liquid-dispensing nozzle comprising a valve housing with a spigot, a filling hose connector and a fuel duct, an operating mechanism with a pistol-grip handle and if desired a flow rate setting mechanism for the pistol-grip handle, an automatic shut off device and a safety device. A valve seat is located near the upstream end of the valve housing and an associated valve body loaded by a closing spring is mounted in the valve housing with an axially slidable valve stem, the valve stem being a hollow spindle, in which is guided a pull rod connected with the pistol-grip handle.

The valve spindle and the pull rod can be couplable and uncouplable by a locking mechanism of the automatic shut off device.

The automatic shut off device can have a pressure equalizing chamber, a vacuum chamber with a filling state sensing duct and with a vacuum duct open near the valve seat and a chamber-separating control membrane, which operates the locking mechanism, the control membrane having a control membrane spring with which the shut off low pressure of the automatic shut off is set, and further the control membrane is connected with free play flexibility to a hollow piston shaft of a safety piston guided in the valve housing, which is movable between a locked in position and a locked out position. On the side facing away from the control membrane the safety piston is acted upon by pressure in the filling hose connector communicated thereto by a pressure duct and is supported with a safety piston spring in the valve housing and is moreover supported on the control membrane.

According to my invention the safety piston is a differential piston with a small effective piston surface and a large effective piston surface. The piston is acted upon in the locked out position through its small effective piston surface by the pressure in the filling hose connector. After overcoming the compressive force of the safety piston spring in the locked in position, the large effective piston surface is acted upon by the pressure in the filling hose connector.

My invention is based on the recognition that a safe lock out is not realized when the delivery pump is shut off with the delivery valve open. Therefore, an additional lock in stop device is required to avoid the above mentioned difficulties.

According to a feature of the invention an upper chamber of the valve housing in which the safety piston is guided is connected by a pressure equalizing gap with the vacuum chamber. The pressure equalizing gap is an effective gap seal when the pressure acts on the small piston surface until in the locked in position where the safety piston can be acted on by the large piston surface by the pressure in the filling hose connector. This can be accomplished reliably and easily when the differential piston or safety piston has a guide ring and a piston seat, the piston seat being free at its edges and the guide ring being movable in a cylinder and of course with the pressure equalizing gap between the guide ring and the cylinder.

Also the safety spring surrounds the cylinder and is braced on the outer edge of the piston seat. The piston seat, moreover, is mountable on a collar on the cylinder to produce its differential effect, i.e. a sealing occurs. The differential piston or safety piston is guided free from sliding sealing means, using only a long narrow gap for sealing purposes. Actually the cylinder in connection with the described structure effects a plunger or cylindrical gap seal which makes special sealing rings with different friction depending on the motion direction not required in the differential or safety piston. In the differential piston equal forces operate in both motion directions. Static sealing rings can be installed where required. They cause no disturbing friction and act as end seals.

In the liquid-dispensing nozzle according to my invention the safety piston spring is so designed that for motion of the safety piston into the locked in position the entire rated pump pressure must be applied. When a delivery is attempted with the liquid-dispensing nozzle according to my invention with the locking mechanism locked out and the delivery pump operated by the pistol-grip handle when the full delivery pump pressure is not present, the locking mechanism can not lock in and the delivery valve can not open. Understandably the pressure acting on the safety piston falls off in the liquid-dispensing nozzle according to my invention, but the described safety piston, because of the differential-pressure action, holds the safety piston in the locked in position. As a result a delivery of fuel occurs only when the delivery pump supplies the rated delivery pump pressure and consequently the hydraulic shut off mechanism functions reliably, even if in the ordinary course of operation of the liquid-dispensing nozzle a haphazard small pressure on the differential piston is allowed, which occurs at the end of the delivery process by shut off of the delivery pump. The safety piston spring designed for the full delivery pump pressure allows no haphazard delivery as a result of compressing the hose.

BRIEF DESCRIPTION OF THE INVENTION

The above and other objects, features and advantages of my invention will become more readily apparent from the following description, reference being made to the accompanying drawing in which.

SPECIFIC DESCRIPTION

Figure 1:
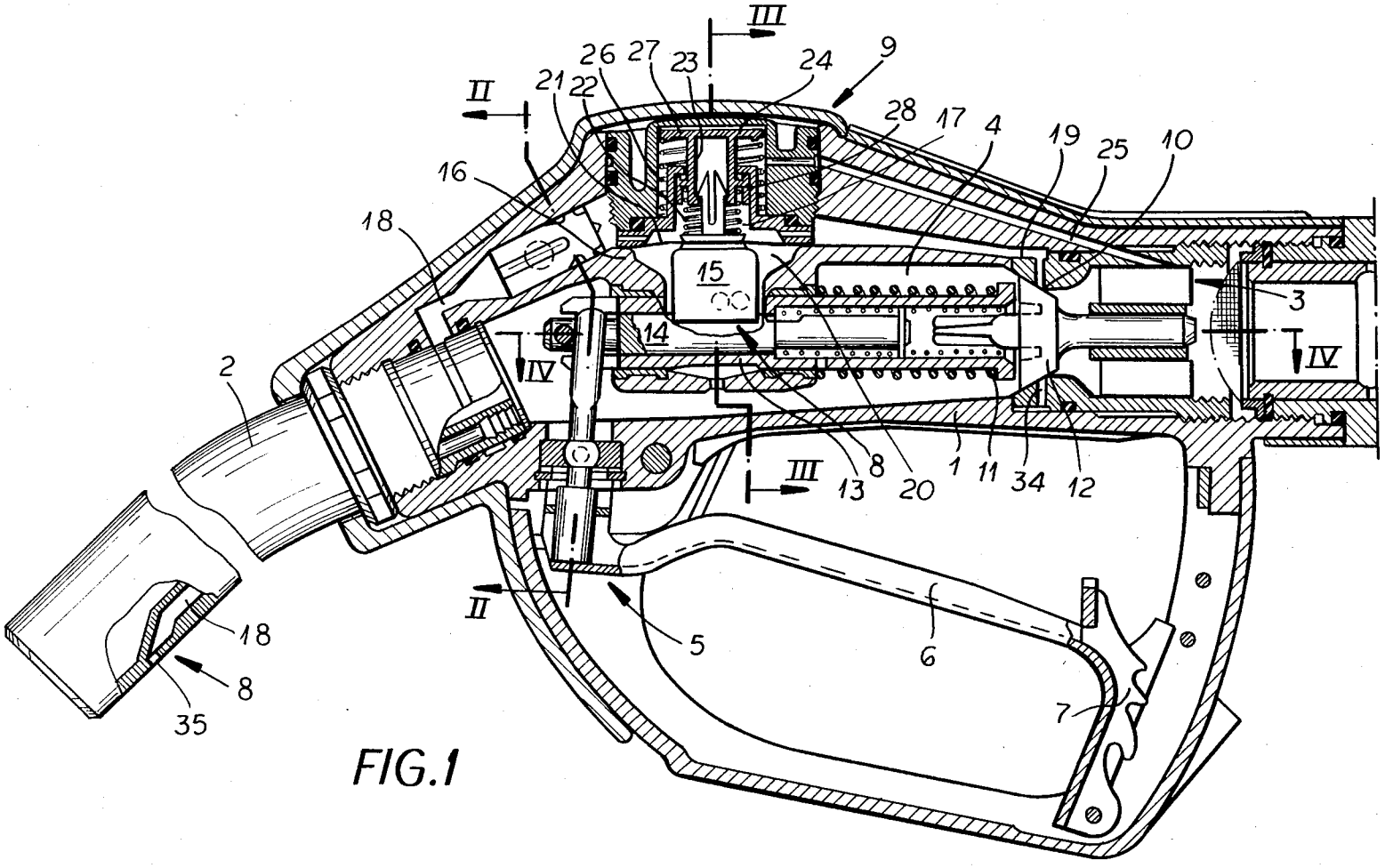
FIG. 1 is an axial cross sectional view of a liquid-dispensing pistol-grip nozzle for delivering fuel according to my invention.
Figure 2:
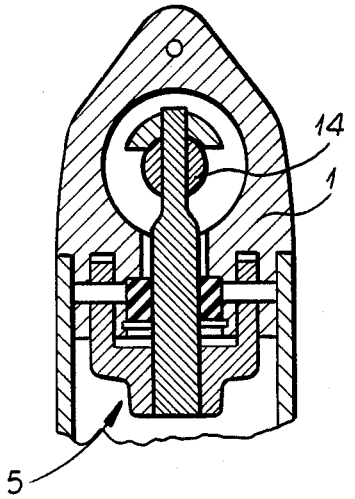
FIG. 2 is a cross sectional view taken along the section line II—II of FIG. 1.
Figure 3:
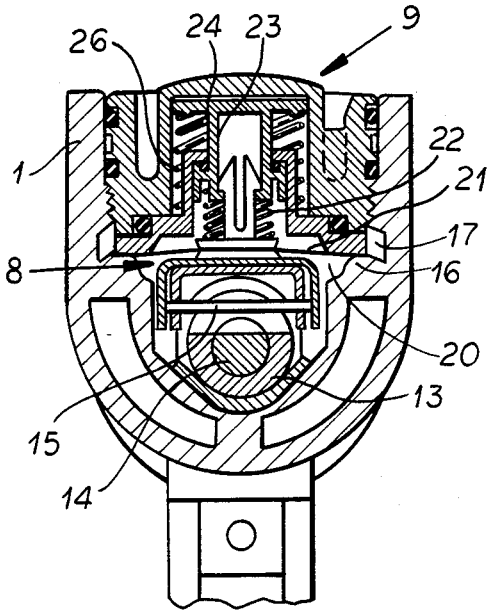
FIG. 3 is a cross sectional view of the upper portion of the apparatus taken along the section line III—III of FIG. 1.
Figure 4:
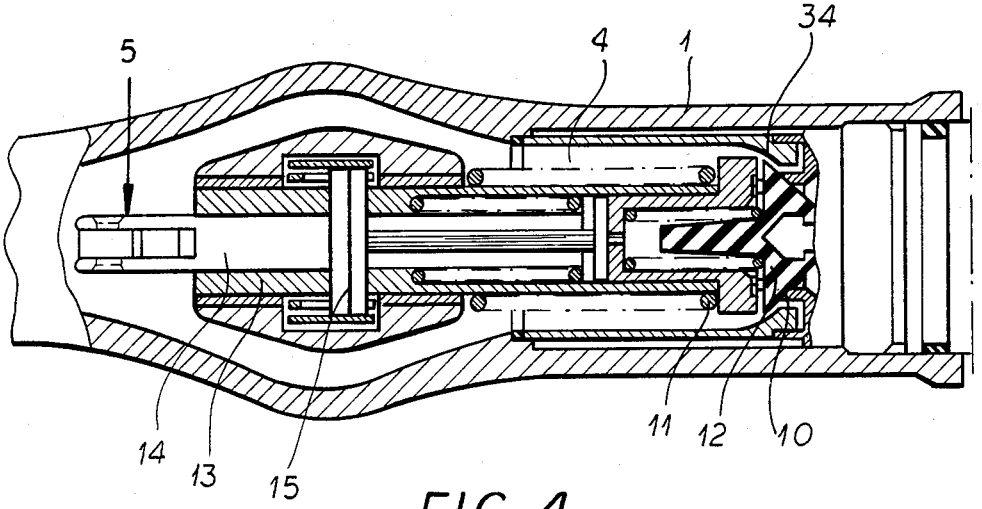
FIG. 4 is a cross sectional view of FIG. 1 taken along the section line IV—IV of FIG. 1.

The liquid-dispensing pistol-grip nozzle shown in the drawing is designed to deliver fuel for a filling hose liquid-dispensing machine equipped with a delivery pump which can be shut off and turned on.

The nozzle comprises a valve housing 1 with a spigot 2, a filling connnector 3 and its fuel duct 4, an operating mechanism 5 with a pistol-grip handle 6 and, if desired a flow rate setting mechanism 7 for the pistol-grip handle 6; the nozzle also includes an automatic shut off device 8 and a safety device 9.

A valve seat 10 is located at the upstream end of the the valve housing 1 and an associated delivery valve body 12 loaded by closing spring 11 is mounted in the valve housing 1 with an axially slidable valve stem 13. The valve stem 13 is a hollow spindle in which a slidable pull rod 14 connected with the operating handle 6 is guided. The valve stem 13 and the pull rod 14 are coupled and uncoupled by a locking mechanism 15 of the automatic shut off device 8.

The automatic shut off device 8 has a pressure equalizing chamber 20, a vacuum chamber 17 with a filling state sensing duct 18 and with a vacuum duct 19 opening near the delivery valve seat 10 and a chamber separating control membrane 21. The control membrane 21 operates the locking mechanism 15.

The control membrane is acted upon by a control membrane compressible spring 22 with which is adjusted the shut off low pressure of the automatic shut off device 8. Adjustment of pressure occurs by appropriate compression of the spring to move piston 24 in a compensating direction.

Figure 5:
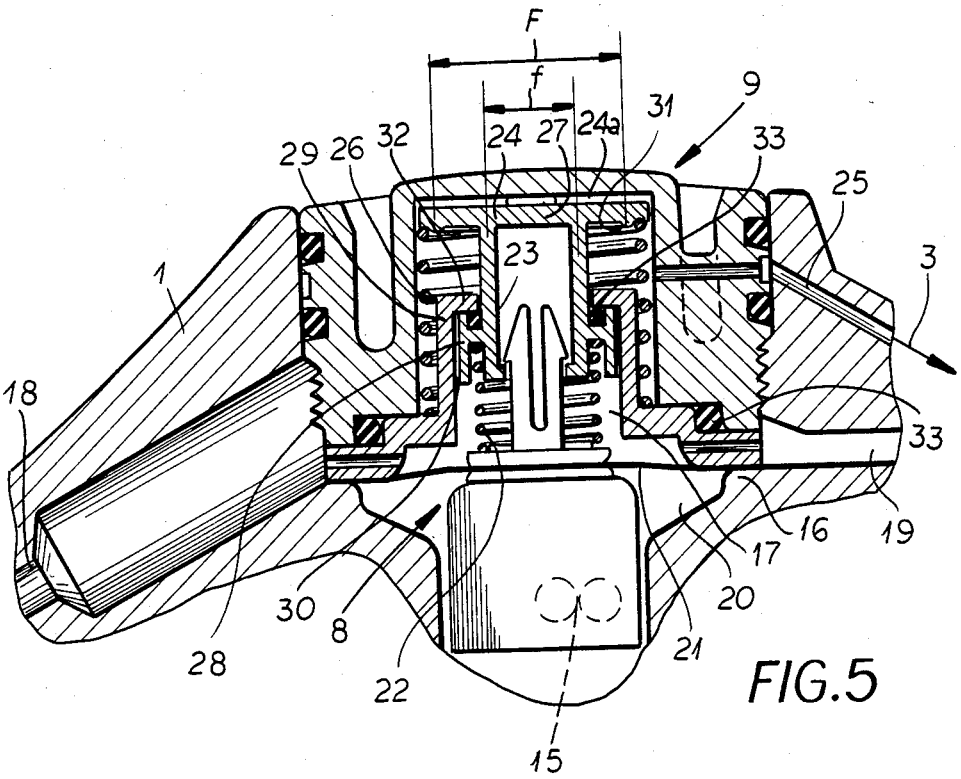
FIG. 5 is a cutaway partial cross sectional view drawn to a larger scale of a liquid-dispensing pistol-grip nozzle according to FIG. 1 showing a safety mechanism and parts of an automatic shut off mechanism.

The control membrane 21 is connected with flexible free play by spring 22 to a hollow piston shaft 23 of a safety piston 24 guided in the housing of the safety device 9. The safety piston 24 is movable between a locked in position (FIG. 6) and a locked out position (FIG.5).

On the side facing away from the control membrane 21 the safety piston 24 can be acted upon by pressure in the filling hose connector 3 because of connection to adjoining upper chamber 24*a* with the connector 3 by a pressure duct 25. The safety piston 24 is biased by a safety piston spring 26 in the valve housing 1. The control membrane spring 22 is additionally engaged with and braced on the safety piston 24.

The safety piston 24 is a differential piston with a small effective piston surface f on one first surface of a piston seat 27 and a large effective piston surface F on a second surface of said seat but on a side opposite said first surface. This differential piston can be acted on in its locked position (FIG. 5) with its small effective piston surface f by the pressure in the filling hose connector 3.

The differential piston, after overcoming the force of the safety piston spring 26, can be acted upon in its locked position with its large effective piston surface F by the pressure in the filling hose connector 3.

Figure 6:
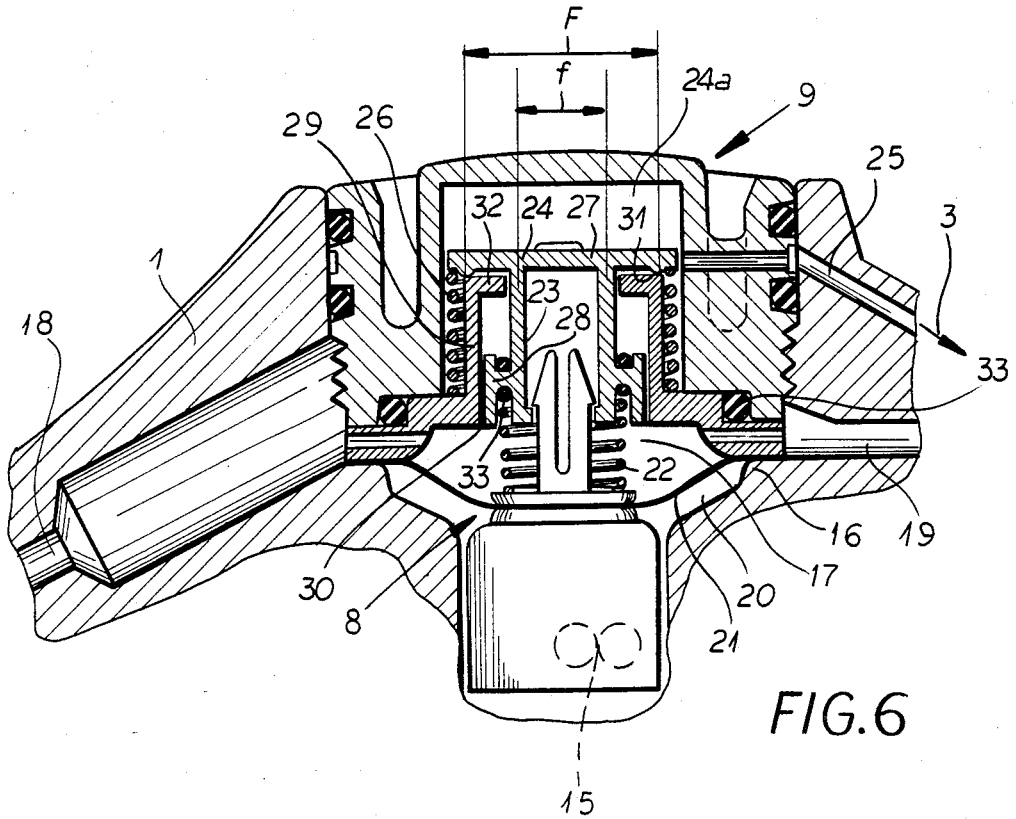
FIG. 6 is a magnified cutaway partial cross sectional view of a liquid-dispensing pistol-grip nozzle similar to FIG. 5 showing the nozzle in a different operating configuration.

The operation is described further below. Particularly the details of this embodiment of my invention are illustrated in FIGS. 5 and 6.

The differential piston 24 has a piston seat 27 and a guide ring 28. The piston seat 27 is free at its edges. The guide ring 28 is movable in a cylinder 29 of the housing of the safety device 9 to and from the control membrane 21, and of course with pressure equalizing gap 30 between the guide ring 28 and the cylinder 29.

The safety piston spring 26 surrounds the cylinder 29 and is braced on the outer edge of the piston seat 27. The piston seat 27 can seat with a corresponding sealing rim 31 on a collar 32 of the cylinder 29.

The differential piston operates without sliding sealing means. A plunger seal or long-gap seal is realized by the cylinder 29, on one hand, and the hollow piston shaft 23 through guide ring 28, on the other hand. Of course static sealing rings 33 are mounted at the required places. The operation of the safety piston 24 is in no way impaired by these rings which are not interposed slidingly between relatively moving parts. When safety piston 24 moves downward from its lock out position (FIG. 5) as a consequence of the vacuum in chamber 17, guide ring 28 moves downward adjacent cylinder 29. Total draw-down of the safety piston 24 occurs under conditions of full liquid delivery through the nozzle system. Between guide ring 28 and cylinder 29 is a small space known as a seal gap. When full liquid delivery abates, gap seal 30 allows for equalization of pressure between vacuum chamber 17 and upper chamber 24*a*, the latter being under atmospheric pressure.

Now the structure and function of the automatic shut off device 8 will be described together with the operation of the nozzle.

FIGS. 1 to 5 show the inactivated state of the ready liquid-delivering pistol-grip nozzle with the delivery pump not operating. With the delivery pump (not shown) duly operating the pistol grip handle 6 is brought into and fixed in the operating position so that fuel flows through the fuel duct 4 and the spigot 2 is connected to the fuel tank of the vehicle being fueled, the spigot being hung in the delivery pipe for the fuel tank or in the fuel tank. Thus, a low pressure arises at 34 which leads to air being sucked into the filling state sensing duct 18 and the vacuum duct 19 while the vacuum chamber 17 is maintained by the control membrane 21 practically below normal pressure.

When the fluid level in the fuel tank or fuel tank delivery pipe reached the mouth of the filling state sensing duct 18 at 35 the filling state sensing duct 18 is closed and the pressure in the vacuum chamber 17 above the membrane 21 is lowered.

The control membrane 21 moves upward away from handle so that the delivery valve spindle 13 and the pull rod 14 are uncoupled and the delivery valve 12 closes under operation of its closing spring 11. The operation of the known liquid-dispensing piston nozzles are independent of that, although it may or may not be already equipped with a safety device 9 (see for example German Patent No. 14 32 456, wherein there also is shown the individual structural details of the liquid-dispensing nozzle). In any case, in the fuel delivery system described, the delivery pump operates in an uninterrupted fashion.

FIG. 5 shows the conditions in the delivery pump when it is shut off or operating with a reduced delivery pump pressure. Operation is not possible since the safety piston 24 is in the locked out position.

In the liquid-dispensing pistol-grip nozzle, the safety piston spring 26 may be designed so that to move the safety piston 24 into the locked position almost the full delivery pressure must be applied. If a delivery is attempted with the locking mechanism 15 locked out and the delivery pump operated by the pistol-grip handle 6 when the complete delivery pressure is not applied, the lock mechanism 15 can not lock in and the delivery valve 12 can not open.

When the complete delivery pressure is applied, the differential piston 24 moves into the locked in position shown in FIG. 6. Understandably the pressure acting on the safety piston 24 falls when the fuel delivery occurs. The differential piston operation nevertheless maintains the safety piston 24 which is the differential piston in the locked in position. As a result a delivery of fuel occurs only when the delivery pump supplies the delivery pump pressure and consequently the hydraulic automatic shut off device 8 functions reliably. In putting the delivery valve into operation a small pressure acting on the differential piston is allowed as occurs for example at the end of the delivery process by shutting off the delivery pump. The safety piston 26 designed for practically the complete delivery pump pressure allows no haphazard delivery which might result from a small applied pressure produced for example by compression of the tubing.

In the safety piston 24 during its motion from the upper position shown in FIG. 5 to the lower position shown in FIG. 6 forces operating from contact of the collar near the pressure equalizing gap 30 and the inner surface are considered in design of the piston 24.

I claim:

1. In a liquid-dispensing nozzle comprising:

a valve housing having an upstream end with a spigot, a filling hose connector and a connected fuel duct, an operating mechanism with a pistol-grip handle, automatic shut off device and a safety device having a locking mechanism;

a valve seat being located near said upstream end of said valve housing and an associated valve body loaded by a closing spring mounted in said valve housing with an axially slidable valve stem, said valve stem being a hollow spindle, in which a pull rod connected with said pistol-grip handle is guided, said valve stem and said pull rod being couplable and uncouplable by said locking mechanism of said automatic shut off device; and said automatic shut off device having a pressure equalizing chamber, a vacuum chamber with a filling state sensing duct and with a vacuum duct open near said valve seat and a chamber-separating control membrane which operates said locking mechanism, said control membrane having a control membrane spring with which is set a below atmospheric pressure limit that when reached shuts off said automatic shut off device, and a hollow piston shaft of a safety piston guided in said valve housing which is movable between a locked in position and a locked out position and further said control membrane being connected with flexible free play to said hollow piston shaft of said piston and said piston having a side facing away from said control membrane is acted upon by pressure in said filling hose connector communicated thereto by a pressure duct and which is supported with a safety piston spring in said valve hosuing, said spring being attached to said control membrane, the improvment wherein said safety piston is a differential piston with a small effective piston surface and a large effective piston surface, said safety piston being acted upon in said locked out position with said small effective piston surface by said pressure in said filling hose connector and said safety piston after overcoming the compressive force of said safety piston spring in said locked in position with said large effective piston surface being acted upon by said pressure in said filling hose connector; and an upper chamber in said valve housing in which is guided said safety piston, said upper chamber communicating with said vacuum chamber through a gap means for equalizing pressure, said gap means being an effective seal when said pressure acts on said small piston surface until in said locked in position where said safety piston can be acted on with said large piston surface by said pressure in said filling hose connector.

2. The improvement according to claim 1 wherein said safety piston has a piston seat having edges and a rim, a cylinder, and a guide ring, said piston seat being free at the edges of said piston seat and said guide ring being movable in said cylinder, and with said gap means between said guide ring and said cylinder, said safety piston spring surrounding said cylinder and being braced on the rim of said piston seat and said piston seat undergoing a sealing contact on a collar of said cylinder.

3. The improvement according to claim 2 wherein said safety piston is guided free by dynamic sealing means that have sealing rings of soft flexible material functioning as primary seals.

4. A liquid-dispensing nozzle comprising:

a valve housing having an upstream end with a spigot;

a filling hose connector and a connected fuel duct;

an operating mechanism with a piston-grip handle and if necessary a flow rate setting mechanism for said pistol grip handle having a locking mechanism;

a valve seat being located near an upstream end of said valve housing and an associated valve body loaded by a closing spring mounted in said valve housing with an axially slidable valve stem, said valve stem being a hollow spindle, in which a pull rod connected with said pistol-grip handle is guided, said valve stem and said pull rod being couplable and uncouplable by said locking mechanism;

a pressure equalizing chamber;

a vacuum chamber with a filling state sensing duct and with a vacuum duct opening near said valve seat;

a chamber-separating control membrane which operates said locking mechanism, said control membrane having a control membrane spring with which is set a below atmospheric pressure limit that when reached automatically shuts off said liquid flow;

a safety piston of a safety device and a hollow piston shaft of said safety piston guided in said valve housing, said safety piston being movable between a locked in position and a locked out position and said control membrane being connected with flexible free play to said hollow piston shaft of said piston and said piston having a side facing away from said control membrane being acted upon by pressure in said filling hose connector communicated thereto by a pressure duct and being supported with a safety piston spring in said valve housing, said spring being attached to said control membrane;

said safety piston being a differential piston with a small effective piston surface and a large effective piston surface, said safety piston being acted upon in said locked out position with said small effective piston surface by said pressure in said filling hose connector and said safety piston after overcoming the compressive force of said safety piston spring in said locked in position with said large effective piston surface being acted upon by said pressure in said filling hose connector; and an upper chamber in said valve housing in which is guided said safety piston, said upper chamber communicating with said vacuum chamber through a gap means for equalizing pressure, said gap means being an effective seal when said pressure acts on said small piston surface until in said locked in position where said safety piston can be acted on with said large piston surface by said pressure in said filling hose connector.

* * * * *